United States Patent [19]

Noborisaka et al.

[11] Patent Number: 4,831,805

[45] Date of Patent: May 23, 1989

[54] PRECAST CONCRETE BOARD FIXING METAL FITTING

[75] Inventors: Mitsuo Noborisaka; Masashi Noborisaka; Toshiaki Fukagai; Takashi Taniguchi; Shinji Tanaka; Yuuji Satou; Kazuhiro Tanaka; Noriaki Yamamoto, all of Hokkaido, Japan

[73] Assignees: Hitachi Metals, Ltd., Tokyo; Sanko Concrete Building Material Manufacturing Co., Ltd., Hokkaido, both of Japan

[21] Appl. No.: 127,017

[22] Filed: Nov. 27, 1987

[30] Foreign Application Priority Data

Nov. 27, 1986 [JP] Japan ..... 61-181169[U]

[51] Int. Cl.[4] ..... E04C 1/40

[52] U.S. Cl. ..... 52/509; 52/235

[58] Field of Search ..... 52/509, 235, 126.1; 248/231.91

[56] References Cited

U.S. PATENT DOCUMENTS 4,565,040 1/1986 Kaminaga ..... 52/235

4,720,952 1/1988 Fricker ..... 52/235

4,739,602 4/1988 Fricker ..... 52/235 X

FOREIGN PATENT DOCUMENTS 2526746 12/1976 Fed. Rep. of Germany ..... 52/235

*Primary Examiner*—David A. Scherbel

*Assistant Examiner*—Creighton Smith

*Attorney, Agent, or Firm*—Sughrue, Mion, Zinn, Macpeak and Seas

[57] ABSTRACT

A metal fitting for fixing a precast concrete board comprises: a supporting metal member with one end portion secured to the board and with the other end portion provided with a first screw to move the board upward and downward through the supporting metal member and a second screw to move the board backward and forward through the supporting metal member; and an adjusting metal member including a base board which is secured to a building's structure, and a pair of third screws for moving the board rightward and leftward through the supporting metal member, so that the position adjustments of the board in the three directions can be achieved independently of one another.

12 Claims, 2 Drawing Sheets

PRECAST CONCRETE BOARD FIXING METAL FITTING

A precast concrete board fixing metal fitting characterized by the provision of a support metal member including at one side portion an upward and downward adjusting screw extending vertically therethrough and a horizontally forward and backward adjusting screw having at least two nuts threaded thereon, and means provided at the other side portion for fastening said support metal member to the precast concrete board; and an adjusting metal member including upstanding plates mounted on a base board, horizontally securable to a building structure, at three side portions thereof except for that side portion confronting the precast concrete board, said plate confronting thhe precast concrete board having a notch extending from its upper portion, rightward and leftward adjusting screws of which distal ends are opposed to each other extending respectively through said right- and left-side plates, disposed perpendicular to the precast concrete board.

DETAILED DESCRIPTION OF THE INVENTION

1. Field of Industrial Utility

This invention relates to a metal fitting for fixing a precast concrete board (hereinafter referred to as "PC board") to a building structure.

2. Prior Art

In most of the conventional PC board fixing metal fittings, for example, as disclosed in Japanese Utility Model Application (OPI) Nos. 134209/1977, 155806/1978 and 40507/1982, through holes are formed through a flange of an L-shaped metal part which is protruded horizontally from a surface of the PC board, and it is adapted to be fixed to a metal member, secured to a building structure such as a beam, by the use of bolts vertically inserted into the through holes.

PROBLEMS TO BE SOLVED BY THE INVENTION

In the installation of the PC board using the conventional fixing metal fittings, the adjustments of the vertically-disposed board in an upward/downward direction, a rightward/leftward direction parallel to the board surface and a forward/backward direction perpendicular to the board surface can not be made independently of one another. And, even in the case where the adjustment in one direction is only needed, the adjustments in all the directions have been required to be made from the beginning.

Therefore, the installation of the PC board using the conventional fixing metal fittings has required a lot of time and labor.

An object of this invention is to overcome the above problems of the prior art and to provide a fixing metal fitting which enables an easy adjustment of the position of a PC board when installing the PC board, thereby improving an installation efficiency.

MEANS FOR SOLVING THE PROBLEMS

This invention has been made in order to achieve the above object and is characterized by the provision of a support metal including at one side portion an upward and downward adjusting screw extending vertically therethrough and a horizontally forward and backward adjusting screw having at least two nuts threaded thereon, and means provided at the other side portion for fastening the support metal member to the precast concrete board; and an adjusting metal member including upstanding plates mounted on a base board, horizontally securable to a building structure, at three side portions thereof except for that side portion confronting the precast concrete board, the plate confronting the precast concrete board having a notch extending from its upper portion, rightward and leftward adjusting screws of which distal ends are opposed to each other extending respectively through the right- and left-side plates, disposed perpendicular to the precast concrete board.

OPERATION

The support metal member, which is fastened at the other side portion to the PC board and has the upward and downward adjusting screw and the forward and backward adjusting screw having at least two nuts threded thereon both of which screws are threadedly connected to the support metal at the one side portion thereof, is placed on the base board between the opposed distal ends of the rightward and leftward adjusting screws of the adjusting metal member in such a manner that the forward and backward adjusting screw is received in the notch formed in the plate confronting the PC board with the two nuts disposed respectively on the front and rear sides of the plate.

Then, the position adjustment in the vertical direction is carried out by turning the upward and downward adjusting screw. And, the position adjustment in the rightward/leftward direction is carried out by turning the rightward and leftward adjusting screws. Further, the position adjustment in the forward/backward direction is carried out by turning the nuts on the forward and backward adjusting screws to position the PC board in place, and the support metal member is clamped between the rightward and leftward adjusting screws, thereby firmly fixing the PC board in position relative to the building structure.

EMBODIMENT

The invention will now be described in detail by way of one embodiment thereof.

Figure 1:
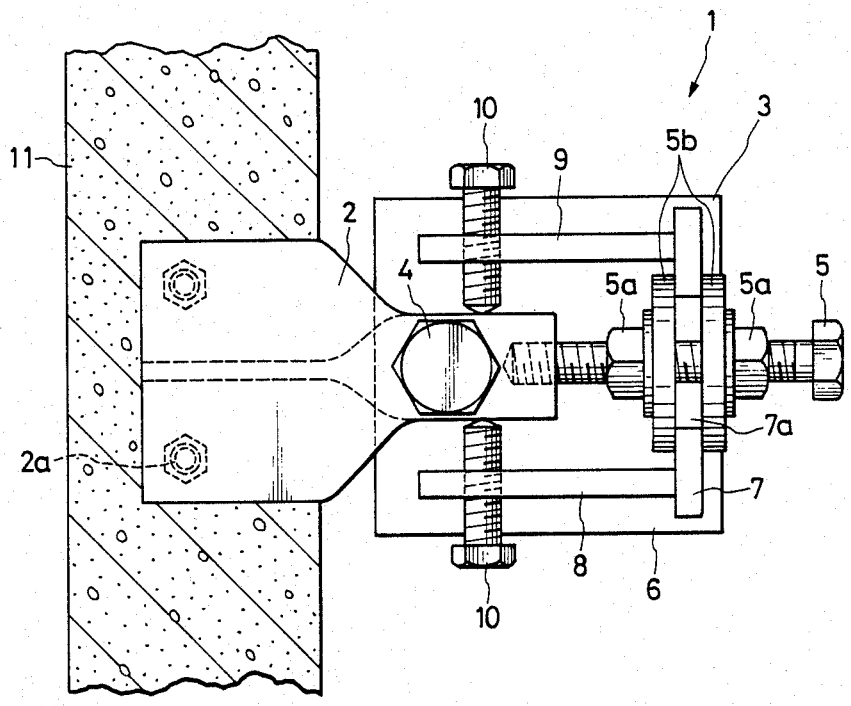
FIG. 1 is a plan view of one embodiment of this invention.
Figure 2:
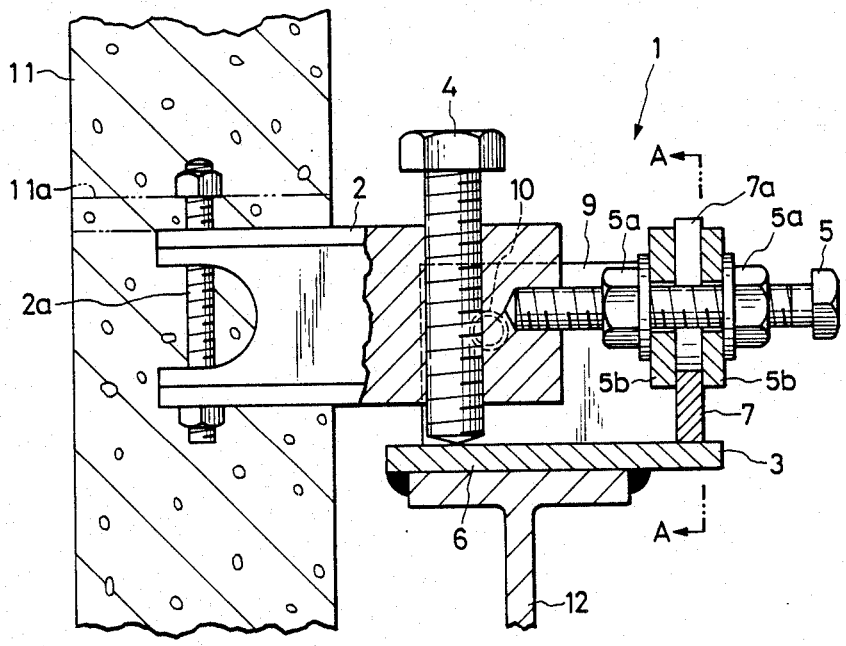
FIG. 2 is a partly cross-sectional, front elevational view.
Figure 3:
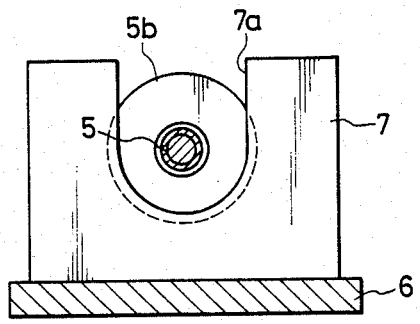
FIG. 3 is a view taken along the line A—A of FIG. 2.

In FIGS. 1 to 3, the PC board fixing metal fitting 1 according to the present invention comprises a support metal member 2 and an adjusting metal member 3. Threadedly connected to the support metal member at one side portion thereof are an upward and downward adjusting screw 4 vertically extending therethrough, and a horizontally forward and backward adjusting screw 5 having two nuts 5*a*, 5*a* threaded thereon, with two washers 5*b*, 5*b* interposed between the two nuts. The support metal member has at the other side portion means for fastening it to a frame member 11*a* of the PC board 11, for example, by bolts 2*a*.

On the other hand, the adjusting metal member 3 includes upstanding plates mounted on a base board 6, horizontally securable, for example, to a beam 12 of a building structure, at three side portions thereof except for that side portion confronting the PC board. The confronting plate 7 confronting the PC board 11 has a notch 7*a* extending from its upper portion, and rightward and leftward adjusting screws 10, 10 are threadedly connected to and extending through the right- and left-side plates 9 and 8, disposed perpendicular to the PC board, with the distal ends of the rightward and leftward adjusting screws being opposed to each other.

The support metal member 2 is fastened to the PC board 11 beforehand. For the installation, as shown in FIG. 1, the side portion of the support metal member to which the upward and downward adjusting screw 4 and the forward and backward adjusting screw 5 are threadedly connected in place on the base board 6 between the distal ends of the rightward and leftward adjusting screws 10, 10 (At this time, one or both of the rightward and leftward adjusting screws 10, 10 have been loosened to increase the spacing therebetween) in such a manner that the forward and backward adjusting screw 5 is received in the notch 7*a* of the confronting plate 7. And, as shown in FIG. 2, the two washers 5*b*, 5*b* are disposed on the opposite sides of the confronting plate 7, and the nuts 5*a*, 5*a* are positioned on the outsides of the washers 5*b*, 5*b*, respectively.

In the case where the width of the notch 7*a* is narrow, the washers 5*b* may be omitted, but in the case where the width is large to obtain a large amount of adjustment in the rightward/leftward direction, it is better to interpose the washers 5*b* as is the case with this embodiment.

For effecting the position adjustments, the nuts 5*a* on the forward and backward adjusting screw 5 are loosened to be free from the confronting plate 7. Thereafter, first, for example, the upward and downward adjusting screw 4 is turned to carry out the position adjustment in the vertical direction. Then, one of the rightward and leftward adjusting screws 10, 10 is turned, and the other is turned in the opposite direction to carry out the position adjustment in the rightward/leftward direction. Then, one of the nuts 5*a*, 5*a* threaded on the forward and backward adjusting screw 5 is turned, and the other is turned in the opposite direction to carry out the position adjustment in the forward/backward direction, thereby positioning the PC board in place. With respect to the order of this positioning operation, the position adjustment may be started in any of the directions.

After the positioning is finished, the rightward and leftward adjusting screws 10 are tightened to firmly clamp the support metal member 2 therebetween, and the nuts 5*a* on the forward and backward adjusting screw 5 are tightened to firmly clamp the confronting plate 7 therebetween through the washers 5*b*, so that the PC board 11 is fixed in the above-mentioned position.

Owing to the weight of the PC board 11 and the tightening forces of the rightward and leftward adjusting screws 10 and nuts 5*a* of the forward and backward adjusting screw 5, a stable fixing on the base board 6 in the vertical direction is achieved.

Therefore, the PC board 11 can be readily and firmly installed in place.

ADVANTAGEOUS EFFECTS

As described above, with the use of the fixing metal fitting according to the present invention, the position adjustments in the upward/downward, rightward/leftward and forward/backward directions can be made independently of each other when the PC board is to be installed, which greatly improves the installation efficiency.

We claim:

1. A metal fitting for fixing a precast concrete board (11), comprising:

a support metal member (2) fixed to said precast concrete board;

a stationary unit (3) which can be secured to a building structure (12);

means for fastening said support metal member to said stationary unit; and means for adjusting a position of said precast concrete board relative to said stationary unit in three different directions, wherein said adjusting means includes a first adjusting means (4) movable vertically, a second adjusting means (5) movable horizontally in a first direction perpendicular to said precast board, and third adjusting means (10) movable horizontally in a second direction in parallel with said precast concrete board.

2. The metal fitting according to claim 1, wherein said adjusting means includes: a first adjusting screw movable vertically, said first adjusting screw being threadedly engaged with said support metal member and being in abutment with said stationary unit; a second adjusting screw movable horizontally in said first direction, said second adjusting screw being threadedly engaged with stationary unit and said support metal member; and a pair of third adjusting screws movable horizontally in said second direction, said third adjusting screws being each threadedly engaged with stationary unit and being each in abutment said support metal member.

3. A metal fitting for fixing a precast concrete board (11), comprising:

a support metal member (2) fixed to said precast concrete board;

a stationary unit (3) which can be secured to a building structure; and means for fastening and adjusting said support metal member relative to said stationary unit in three different directions, wherein said fastening and adjusting means includes a first fastening and adjusting means (4) movable vertically, a second fastening and adjusting means (5) movable horizontally in a first direction perpendicular to said precast board, and third fastening and adjusting means (10) movable horizontally in a second direction in parallel with said precast concrete board.

4. The metal fitting according to claim 3, wherein said fastening and adjusting means includes: a first fastening and adjusting screw movable vertically, said first fastening and adjusting screw being threadedly engaged with said support metal member and being in abutment with said stationary unit; a second fastening and adjusting screw movable horizontally in said first direction, said second fastening and adjusting screw being threadedly engaged with stationary unit and said support metal member; and a pair of third adjusting screws movable horizontally in said second direction, said third fastening and adjusting screws being each threadedly engaged with stationary unit and being each in abutment said support metal member.

5. A metal fitting for fixing a precast concrete board, which comprises:

a supporting metal member having one end portion with which a first adjusting screw movable upwardly and downwardly is threadedly engaged in such a manner that said first adjusting screw penetrates said one end portion vertically and with which a second adjusting screw movable forwardly and backwardly in a horizontal plane is threadedly engaged, and the other end portion with fixing means adapted to fix said supporting metal member to said precast concrete board; and an adjusting metal member comprising:

a base board which can be secured to a building structure in such a manner that said base board is held horizontally;

three boards held upright on said base board in such a manner that said three boards are extended along three sides of said base board other than the side extended along said precast concrete board, one of said three boards which is confronted with said precast concrete board having a cut in the upper end portion thereof; and third adjusting screws which are threadably engaged with the remaining boards, respectively, in such a manner that said third adjusting screws penetrate said remaining boards with the ends thereof confronted with each other.

6. The metal fitting as recited in claim 5, wherein the supporting metal includes washers positioned on both sides of the confronting board and nuts positioned outside said washers, and wherein a diameter of said washers is larger than a dimension of said cut.

7. A metal fitting for fixing a precast concrete board (11), comprising:

a support metal member (2) fixed to said precast concrete board;

a stationary unit (3) which can be secured to a building structure (12);

means for fastening said support metal member to said stationary unit; and means for adjusting a position of said precast concrete board relative to said stationary unit in three different directions, wherein said stationary unit has a base board (6) and three boards (7, 8, 9) held upright on said base board in such a manner that said three boards extend along three sides of said base board other tha the side confronted toward said precast concrete board.

8. The metal fitting according to claim 7, wherein one of said three boards which is in parallel with said precast concrete board has a cut in an upper end portion thereof.

9. The metal fitting according to claim 8, wherein the confronted board includes washers positioned on both sides of said parallel board and nuts positioned outside said washers, and wherein a diameter of said washers is larger than a dimension of said cut.

10. A metal fitting for fixing a precast concrete board (11), comprising:

a support metal member (2) fixed to said precast concrete board;

a stationary unit (3) which can be secured to a building structure; and means for fastening and adjusting said support metal member relative to said stationary unit in three different directions, wherein said stationary unit has a base board (6) and three boards (7, 8, 9) held upright on said base board in such a manner that said three boards extend along three sides of said base board other than the side confronted toward said precast concrete board.

11. The metal fitting according to claim 10, wherein one of said three boards which is parallel with said precast concrete board has a cut in an upper end portion thereof.

12. The metal fitting according to claim 11, wherein the parallel board includes washers positioned on both sides of said confronted board and nuts positioned outside said washers, and wherein a diameter of said washers is larger than a dimension of said cut.

* * * * *